US006199305B1

(12) United States Patent
Steuerwald et al.

(10) Patent No.: US 6,199,305 B1
(45) Date of Patent: Mar. 13, 2001

(54) SHOE

(76) Inventors: Johannes Steuerwald, Doktor Str. 1, Bedburg; Ingrid Schabsky, Römer Str. 43, Kranenburg, both of (DE)

( * ) Notice: Subject to any disclaimer, the term of this patent is extended or adjusted under 35 U.S.C. 154(b) by 0 days.

(21) Appl. No.: 09/348,363

(22) Filed: Jul. 7, 1999

(30) Foreign Application Priority Data

Jul. 7, 1998 (DE) ..... 198 30 334

(51) Int. Cl.[7] ..... A43C 11/00
(52) U.S. Cl. ..... 36/50.1; 36/138; 36/102
(58) Field of Search ..... 36/50.1, 51, 54, 36/102, 138, 97, 45

(56) References Cited

U.S. PATENT DOCUMENTS

D. 98,150 * 1/1936 Drake ..... 36/51
536,345 * 3/1895 Harris ..... 36/51
4,215,493 * 8/1980 Antonious ..... 36/51
4,270,285 * 6/1981 Antonious ..... 36/51
4,476,639 * 10/1984 Zaccaria ..... 36/51

FOREIGN PATENT DOCUMENTS

203398 * 5/1959 (AT) .

* cited by examiner

*Primary Examiner*—Paul T. Sewell
*Assistant Examiner*—Jila Mohandesi
(74) *Attorney, Agent, or Firm*—Muramatsu & Associates

(57) ABSTRACT

A shoe produced by a vamp cut method and having an enlarged slip-on region while ensuring proper fitting and gripping on the foot. The shoe is formed with a sole, a vamp cut shaft, an apron, and a closure element cooperating with the apron. The closure element is variable in length and fastened by one end to the apron and by the other end in the region of the sole.

8 Claims, 2 Drawing Sheets

SHOE

FIELD OF THE INVENTION

The invention relates to a shoe produced by the vamp cut method, and more particularly, to a shoe having an enlarged slip-on region while ensuring the proper fitting and gripping on the foot.

BACKGROUND OF THE INVENTION

Shoes of this type are known in practice which basically have a sole, a vamp cut shaft or upper, an apron and a closure element co-operating with the apron, To enlarge the slip-on region, in the region of the vamp cut there is provided a cut-out which is covered over by the apron. The parts of the vamp cut laterally bounding the cut-out are customarily held together by a strip of elastic.

The closure element is arranged in the manner of a bar or a bar seas transversely over the apron, and is rigidly fixed both to the apron and to the vamp cut shaft. The closure element has in particular the function of ensuring the necessary grip of the shoe on the foot.

To enlarge the slip-on region when pulling on the shoe, the apron is bent forwards, the upper edge of the bar-like closure element acting as a rotation axis. Although the length of the slip-on region is thereby increased by about 25%, it is relatively difficult to pull on such a shoe without a shoe-horn.

If the bar-like closure element were to be displaced further towards the toe of the shoe and thus make it possible to open up the apron further, it would indeed be easier to pull the shoe on, but the grip of the shoe on the foot would be correspondingly impaired.

SUMMARY OF THE INVENTION

The problem on which the invention is based is therefore that of improving the shoe according to the preamble of claim 1 so that the slip-on region is enlarged, without impairing the fitting and the grip of the shoe on the foot.

This problem is solved according to the invention by means of the features recited in the pending claims. According to the invention, the closure element co-operating with the apron is variable in length and is fastened by one end to the apron and by the other end in the region of the sole.

Further developments of the invention are the subject of the subsidiary claims.

In a preferred exemplary embodiment, on both sides of the shoe a variable-length closure element of this type is provided which extends in each case from the outer apron obliquely rearwards and downwards and is fixed to the sole in an edge of the latter.

This construction offers not only a considerably enlarged slip-on region, but also an improved possibility of adapting the shoe to the individual foot shape of the wearer, so that pressure problems can be excluded. These shoes are therefore extremely comfortable from the first wearing, and need no longer be worn in.

BRIEF DESCRIPTION OF THE DRAWINGS

Further advantages and developments of the invention are explained in more detail by means of the description of an exemplary embodiment and the drawings.

In the drawings

DETAILED DESCRIPTION OF THE PREFERRED EMBODIMENTS

Figure 1:
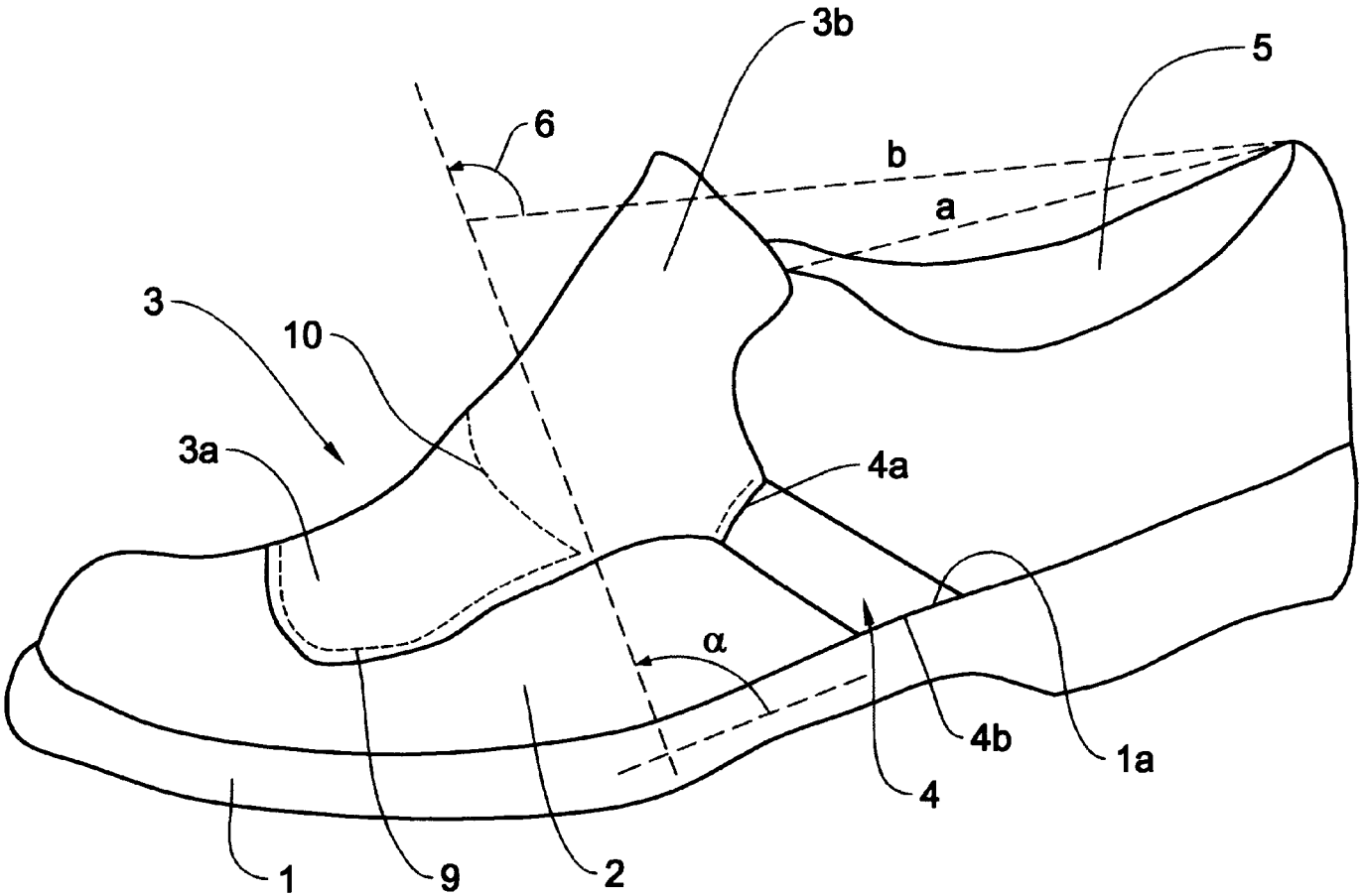
FIG. 1 is a three-dimensional view of the shoe.

The shoe illustrated in the drawings consists basically of a sole 1, a vamp cut shaft or upper 2, an apron 3 and a closure element 4 co-operating with the apron 3.

Figure 2:
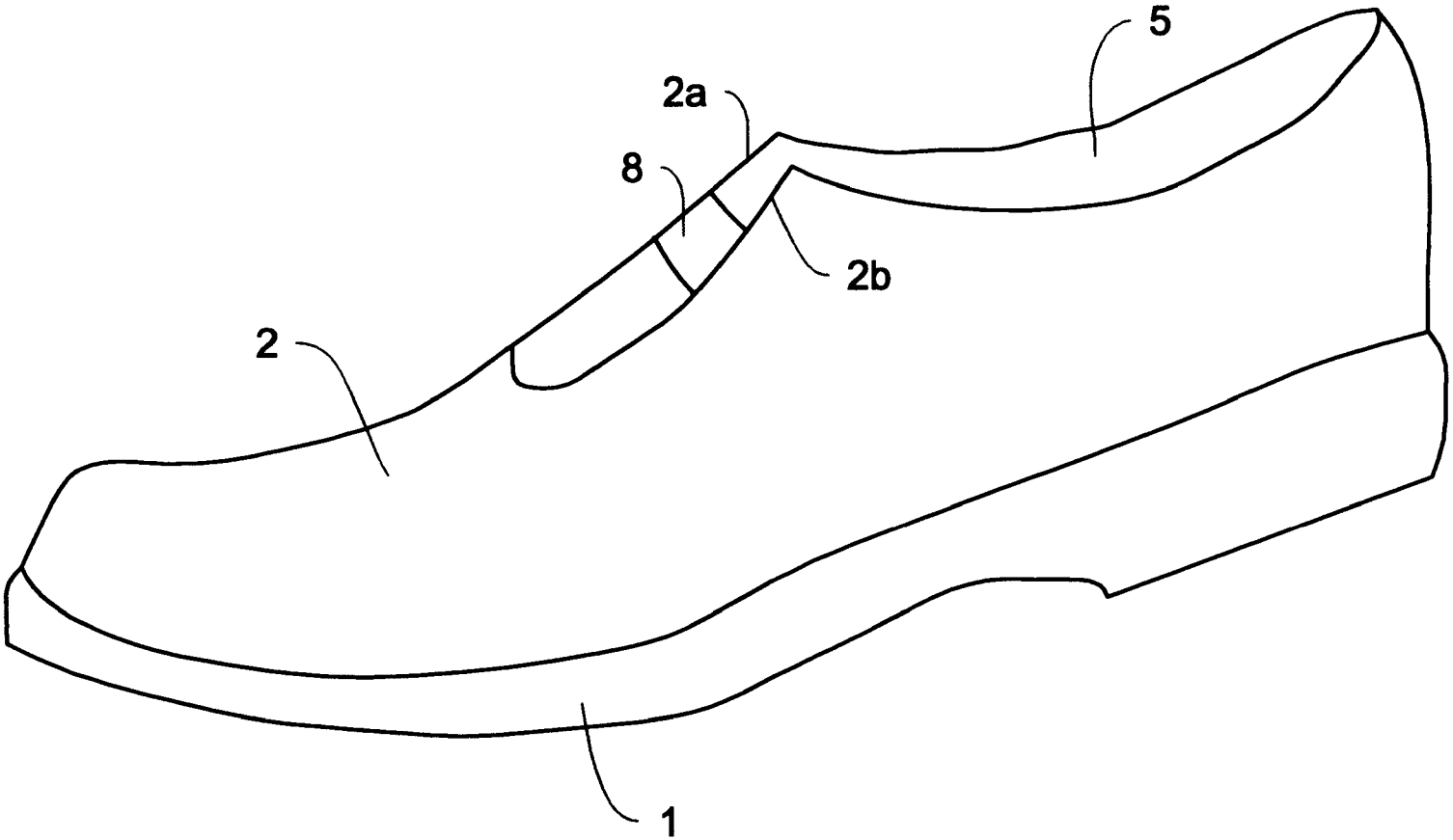
FIG. 2 is a three-dimensional view of the shoe without apron and closure element.

The shoe further has a slip-on region 5 which can be enlarged by folding forward the apron 3. To increase the slip-on region, the vamp cut shaft 2 further has a cut-out 7 (see FIG. 2) which is covered over by the apron 3. In FIG. 2, in order to show the cut-out 7 more clearly, the apron 3 and the closure element 4 have been omitted.

The cut-out 7 is bounded laterally by means of two parts 2*a*, 2*b* of the vamp cut shaft 2, the two laterally bounding parts 2*a*, 2*b* being held together by resilient means 8, especially a strip of elastic. The cut-out 7 can therefore be enlarged by pulling apart laterally the two parts 2*a*, 2*b* of the vamp cut shaft 2, so that the slip-on region 5 is also enlarged simultaneously. The elastic strip 8 is stretched thereby and, after the shoe has been pulled on, ensures smooth fitting of the vamp cut shaft 2 on the foot.

In order to ensure that the shoe grips reliably on the foot even while walking or running, however, the apron 3 illustrated in FIG. 1 is additionally required, which has a first part 3*a* rigidly fixed to the vamp cut shaft 2 and a second part 3*b* movable with respect to the vamp cut shaft 2. The first part 3*a* rigidly fixed to the vamp cut shaft is formed by the front part of the apron 3, seen in the longitudinal direction of the shoe, which is customarily rigidly fixed for this purpose in its edge region by means of a seam 9 to the vamp cut shaft 2. The line connecting the two lateral end points of the seam 9 forms the pivot axis 10, about which the movable part 3*b* of the apron 3 can be folded forward.

The further the seam 9 is taken upwards in the direction of the slip-on region 5, the smaller the movable part 3*b* becomes with respect to the rigidly fixed part 3*a*. The enlargement of the slip-on region 5 is then correspondingly less when the movable part 3*b* of the apron 3 is folded back.

The slip-on region 5 accordingly becomes larger, the shorter the seam 9 is made. An ever-increasing slip-on region, however, necessarily has the result that the grip of the shoe on the foot becomes ever poorer.

To improve the grip of the shoe on the foot, the closure element 4 is therefore provided, which is variable in length and is fastened by one end 4*a* to the apron 3 and by the other end 4*b* in the region of the sole 1. The end 4*b* is preferably fixed to the sole in an edge 1*a* of the latter.

In order now to allow on the one hand the largest possible slip-on region 5, which is ensured by a corresponding length of the seam 9, and on the other hand a secure grip of the shoe on the foot, the variable-length closure element 4 extends in a preferred exemplary embodiment from the apron 3 obliquely rearwards and downwards. During walking, the foot exerts on the apron a force tending to fold the apron 3 forwards (see arrow 6). The closure element extending obliquely rearwards acts precisely counter to this force.

The variable-length closure element 4 is advantageously provided on both sides of the shoe and fixed there in each case to the apron and the sole.

In a preferred exemplary embodiment, the variable-length closure element 4 is formed by a resilient element, especially a strip of elastic. By means of corresponding arrangement of the resilient element, it is possible on the one hand for the shoe to grip the foot securely and on the other hand for the apron 3 to be folded forward easily.

The construction of the shoe described above makes it possible for the apron 3 and the closure element fastened thereto to be of such dimensions that the movable part 3*b* of the apron 3, in the slip-on position (that is to say, with the movable part folded forwards) forms a slip-on angle α of more than 90° with respect to the sole 1.

By folding forward the apron 3, the length a of the slip-on region 5 can be increased to a length b which is 50% greater than the length a, preferably 70% greater.

This shoe construction thus offers a significantly enlarged slip-on region, so that the use of a shoe-horn to pull on the shoe is no longer necessary. By means of the variable-length closure element 4, there is additionally an improved possibility of fitting the shoe to the individual foot shape of the wearer, so that pressure problems can be excluded. A special advantage also lies in particular in the fact that these shoes no longer need to be worn in.

What is claimed is:

1. A shoe, comprising:

a) a sole (1), b) a vamp cut shaft (2), c) an apron (3) which is partially connected to the vamp cut shaft (2) at a front side of the shoe while its free end is extended to a slip-on region (5), wherein the apron (3) has a first part (3*a*) rigidly fixed to the vamp cut shaft (2) and a second upper part (3*b*) the sides which are slidable with respect to the vamp cut shaft, and a closure element (4) being fastened on the slidable second part (3*b*) of the apron (3), d) and a closure element (4) co-operating with the apron (3), wherein the closure element (4) is elastically formed to be variable in length and is fastened by one end (4*a*) to the apron (3) and by the other end (4*b*) in the region of the sole (1).

2. A shoe according to claim 1, wherein the closure element (4) is provided on both sides of the shoe between the apron (3) and the sole (1).

3. A shoe according to claim 1, wherein the closure element (4) is fixed to the sole (1) in an edge (1*a*) of the latter.

4. A shoe according to claim 1, wherein the closure element (4) extends obliquely rearwards and downwards from the apron (3).

5. A shoe according to claim 1, wherein the apron (3) and the closure element (4) fastened thereto elastically extends so that the movable part (3*b*) of the apron (3), in a slip-on position, forms a slip-on angle (α) of more than 90° with respect to the sole (1).

6. A shoe according to claim 1, wherein the apron (3) and the closure element fastened thereto are elastically extend so that the length (a) of the slip-on region (5), in the slip-on position of the apron (3), can be enlarged by more than 50%, preferably more than 70%.

7. A shoe according to claim 1, wherein the closure element (4) is in the form of a resilient element, especially a strip of elastic.

8. A device according to claim 1, wherein the vamp cut shaft (2), in order to enlarge the slip-on region (5), has a cut-out (7) which is covered over by means of the apron (3), the parts (2*a*, 2*b*) of the vamp cut shaft (2) which laterally bound the cut-out being held together by resilient means (8).

* * * * *